US011712779B2

(12) United States Patent
Kuo et al.

(10) Patent No.: US 11,712,779 B2
(45) Date of Patent: Aug. 1, 2023

(54) PROTECTIVE DEVICE OF POWER TOOL

(71) Applicant: MOBILETRON ELECTRONICS CO., LTD., Taichung (TW)

(72) Inventors: Tung-Chin Kuo, Taichung (TW); Jui-Chen Huang, Taichung (TW)

(73) Assignee: Mobiletron Electronics Co., Ltd., Taichung (TW)

( * ) Notice: Subject to any disclaimer, the term of this patent is extended or adjusted under 35 U.S.C. 154(b) by 477 days.

(21) Appl. No.: 16/944,615

(22) Filed: Jul. 31, 2020

(65) Prior Publication Data

US 2021/0053186 A1 Feb. 25, 2021

(30) Foreign Application Priority Data

Aug. 22, 2019 (TW) ..... 108130028

(51) Int. Cl.
*B24B 55/05* (2006.01)
*B25F 5/02* (2006.01)

(52) U.S. Cl.
CPC ..... *B24B 55/052* (2013.01); *B25F 5/02* (2013.01)

(58) Field of Classification Search
CPC ..... B24B 55/052; B24B 47/10; B24B 47/12; B24B 47/26; B24B 45/00; B24B 45/003;
(Continued)

(56) References Cited

U.S. PATENT DOCUMENTS 8,235,139 B2 * 8/2012 Chen ..... F16D 63/006 408/239 R
2007/0131439 A1 * 6/2007 Hashimoto ..... B25D 16/006 173/48

(Continued)

FOREIGN PATENT DOCUMENTS

CN 201711848 U 1/2011
CN 201889718 U 7/2011

(Continued)

OTHER PUBLICATIONS

English abstract for CN103158071, Total of 1 page.

(Continued)

*Primary Examiner* — Orlando E Aviles
*Assistant Examiner* — Sharonda T Felton
(74) *Attorney, Agent, or Firm* — Apex Juris, PLLC; R. Lynette Wylie

(57) ABSTRACT

A protective device of a power tool includes a fixing base having a tube portion and an abutting surface, a restricting ring fitting around the tube portion, several springs disposed between the abutting surface and a first end of the restricting ring, a protective cover having several second projections and several second recesses, and a locking member. The first end has an abutting portion. A second end of the restricting ring has several first projections and several first recesses matching with the second projections and the second recesses. The restricting ring is located between the protective cover and the abutting surface. When a blocking portion of the locking member moves to a first position, the blocking portion restricts the restricting ring from moving toward the abutting surface. When the blocking portion moves to a second position, the blocking portion leaves a position between the abutting surface and the abutting portion.

12 Claims, 12 Drawing Sheets

(58) Field of Classification Search
CPC ..... B24B 45/0006; B24B 55/04; B24B 55/05; B24B 55/06; B24B 55/10; B24B 55/102; B25F 5/02
USPC ..... 451/359
See application file for complete search history.

(56) References Cited

U.S. PATENT DOCUMENTS

| | | | | |
|---|---|---|---|---|
| 2009/0078524 | A1* | 3/2009 | Christensen | F16D 7/08 192/56.6 |
| 2010/0178857 | A1* | 7/2010 | Esenwein | B24B 55/052 451/451 |
| 2016/0016285 | A1* | 1/2016 | Cooksey | B24B 23/028 451/359 |
| 2016/0039068 | A1 | 2/2016 | Morris et al. | |
| 2018/0236634 | A1* | 8/2018 | Chen | B24B 55/052 |

FOREIGN PATENT DOCUMENTS

| | | | | | |
|---|---|---|---|---|---|
| CN | 103158071 | A | | 6/2013 | |
| CN | 204565910 | U | | 8/2015 | |
| CN | 107553415 | A | | 1/2018 | |
| CN | 207373102 | U | * | 5/2018 | |
| CN | 207746863 | U | | 8/2018 | |
| CN | 109382798 | A | | 2/2019 | |
| DE | 10115635 | C1 | | 10/2002 | |
| DE | 10343060 | A1 | * | 4/2005 | B24B 23/005 |
| DE | 102012112621 | A1 | | 6/2014 | |

OTHER PUBLICATIONS

English abstract for CN107553415, Total of 1 page.
English abstract for CN109382798, Total of 1 page.
English abstract for CN201711848, Total of 1 page.
English abstract for CN201889718, Total of 1 page.
English abstract for CN204565910, Total of 1 page.
English abstract for CN207746863, Total of 1 page.
English abstract for DE10115635, Total of 1 page.
English abstract for DE102012112621, Total of 1 page.
Search report for CN201910800248.9, dated Jul. 27, 2021, Total of 3 pages.

* cited by examiner

PROTECTIVE DEVICE OF POWER TOOL

BACKGROUND OF THE INVENTION

Technical Field

The present invention relates generally to a power tool, and more particularly to a protective device of a power tool, wherein an angle of a protective cover of the protective device could be adjusted.

Description of Related Art

A conventional power tool has an output shaft connected to a tool bit, wherein the output shaft can drive the tool bit to rotate, and a user can use the tool bit to process a workpiece. Taking a hand-held grinder as an example, the tool bit is a grinding wheel. The user holds a body of the grinder and contacts the workpiece with the high-speed rotating grinding wheel to grind the workpiece. However, when the grinding wheel is in contact with the workpiece, material on a surface of the workpiece will be brought out by the grinding wheel, so that the waste material is sprayed out at a high speed in a form of dust, particles or sparks.

For preventing the waste material from spraying everywhere, most of the conventional power tools will be disposed with a protective cover to block the waste material, thereby to prevent the user from injury due to the spraying waste material. However, the conventional protective cover is fixedly installed on the power tool, and the user cannot adjust an angle of the protective cover. Therefore, when the power tool is used to process the workpiece at certain angles, the waste material may still be sprayed to the user.

BRIEF SUMMARY OF THE INVENTION

In view of the above, the primary objective of the present invention is to provide a protective device of a power tool, wherein a user could adjust an angle of a protective cover of the protective device depending on the required demand.

The present invention provides a protective device of a power tool, which includes a fixing base, a restricting ring, a plurality of springs, a protective cover, and a locking member, wherein the fixing base is adapted to be engaged with the power tool and has a tube portion and an abutting surface. The tube portion is adapted to be passed through by an output shaft of the power tool. The abutting surface is located on an outer periphery of the tube portion. The restricting ring fits around the tube portion and is movable in an axial direction of the tube portion, wherein the restricting ring has a first end and a second end which face opposite directions. The first end faces the abutting surface of the fixing base and has an abutting portion. The second end has a plurality of first projections which are arranged in an annular shape and are arranged at intervals and a plurality of first recesses which are arranged in an annular shape and are arranged at intervals. The first projections and the first recesses are arranged alternately. The springs are disposed between the abutting surface of the fixing base and the first end. The protective cover is rotatably disposed on the fixing base, wherein the restricting ring is located between the protective cover and the abutting surface of the fixing base. The protective cover has an engaging ring. The engaging ring has a plurality of second projections which are arranged in an annular shape and are arranged at intervals and a plurality of second recesses which are arranged in an annular shape and are arranged at intervals. The second projections and the second recesses are arranged alternately. Each of the second projections is disposed in one of the first recesses, and each of the first projections is disposed in one of the second recesses. The locking member is disposed between the restricting ring and the fixing base and has an operating portion and a blocking portion, wherein the operating portion is adapted to be operated by a user, thereby to move the blocking portion between a first position and a second position. When the blocking portion is located at the first position, the blocking portion is located between the abutting surface of the fixing base and the abutting portion of the first end of the restricting ring, thereby to restrict the restricting ring from moving toward the abutting surface of the fixing base. When the blocking portion is located at the second position, the blocking portion is not located between the abutting surface of the fixing base and the abutting portion of the first end of the restricting ring, so that when the protective cover is rotated, each of the second projections leaves the corresponding first recess to push the restricting ring toward the abutting surface of the fixing base.

With the aforementioned design, when the user operates the operating portion of the locking member to move the locking member to the second position, the angle of the protective cover could be adjusted by rotating the protective cover, which is easier to use and enhances security while using the power tool.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
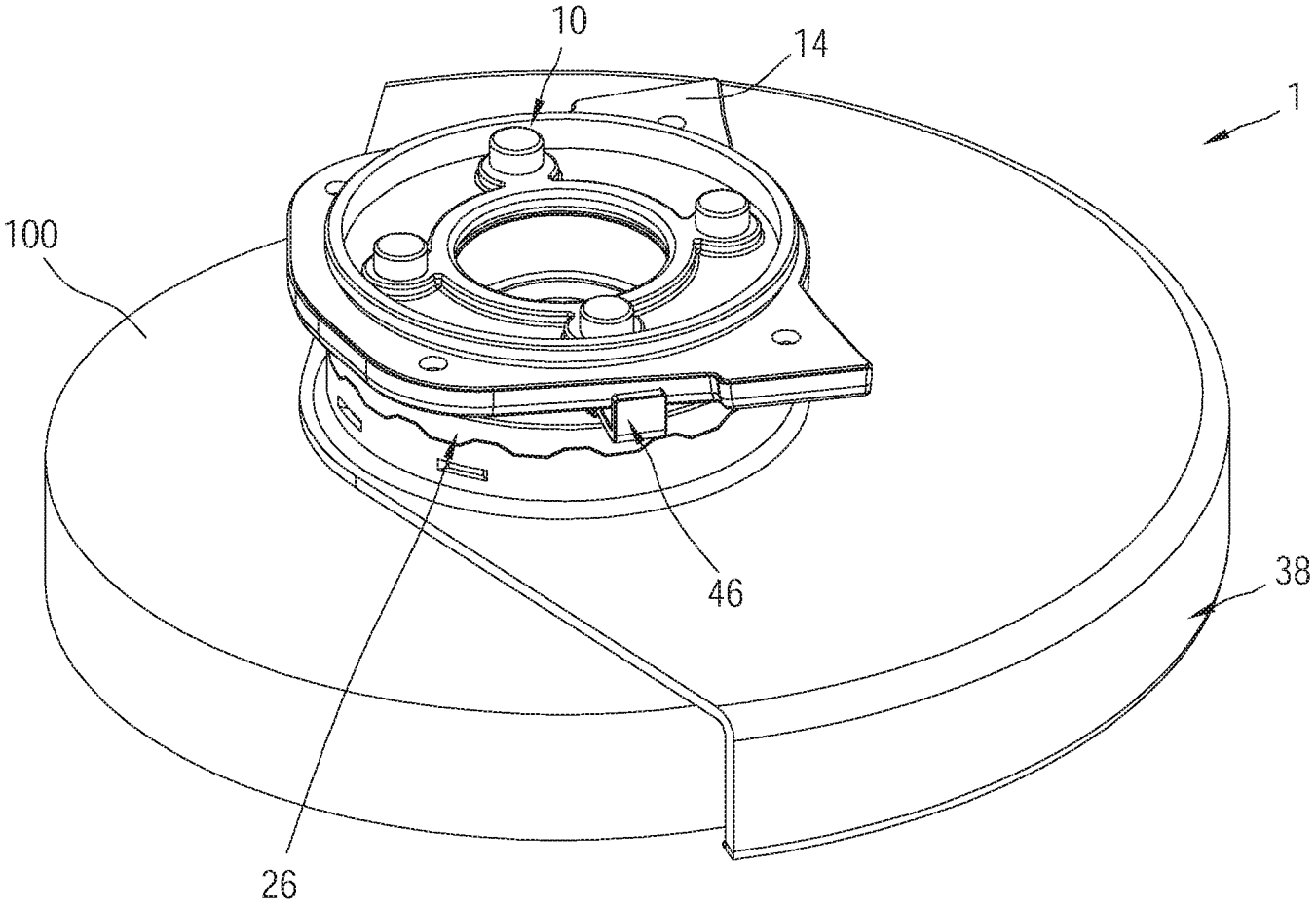
FIG. 1 is a perspective view of the protective device of the power tool according to an embodiment of the present invention.
Figure 2:
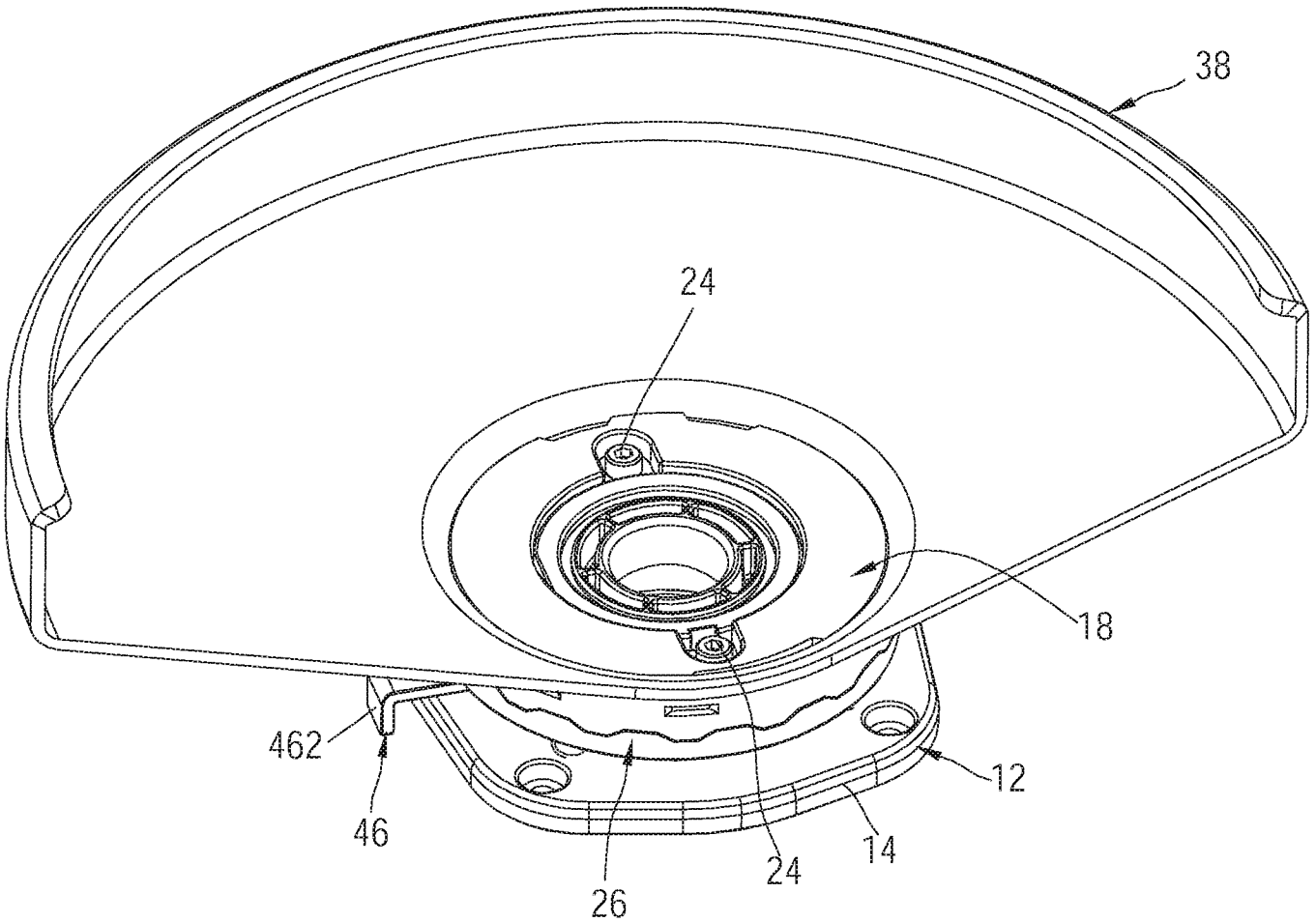
FIG. 2 is a perspective view, showing the protective device of the power tool according to the embodiment of the present invention seen from another direction.
Figure 3:
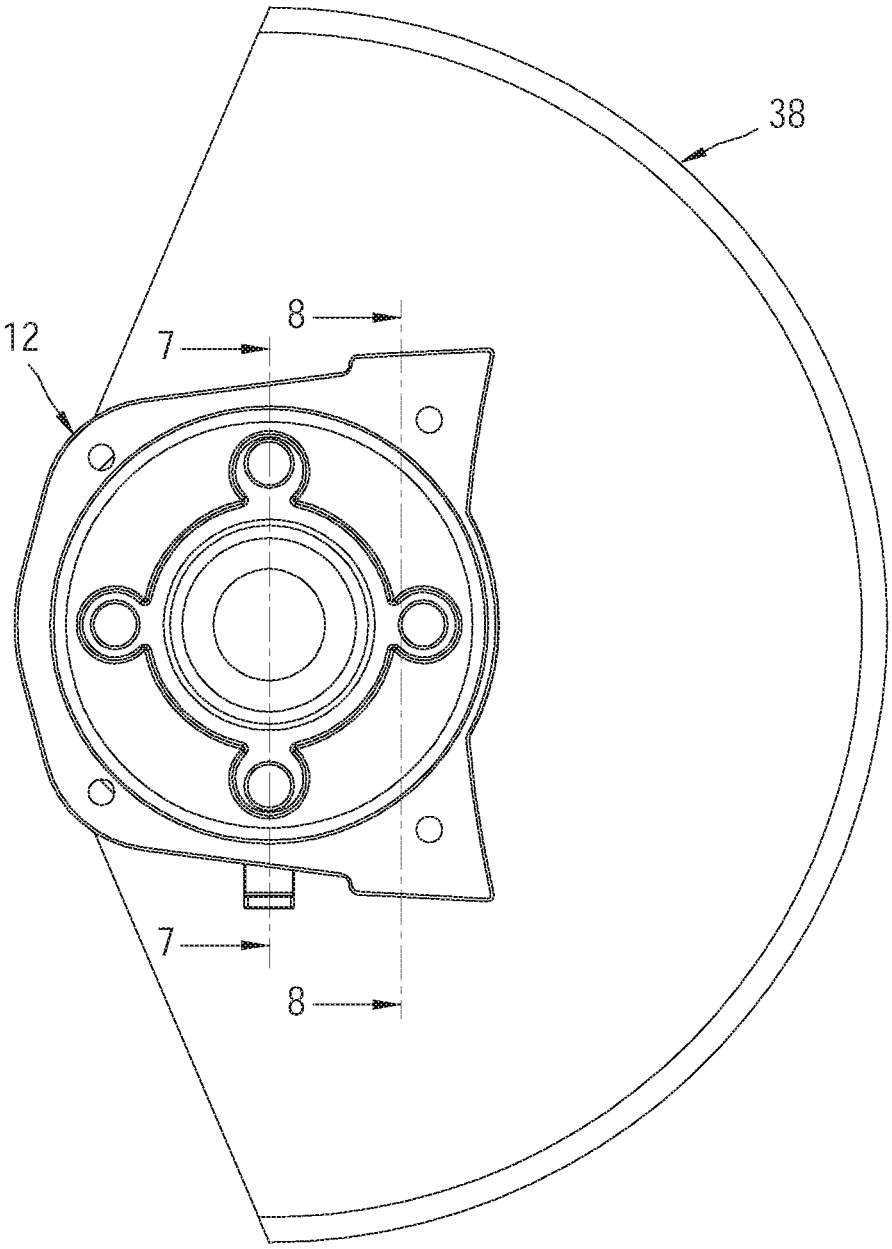
FIG. 3 is a top view of the protective device according to the embodiment of the present invention.

A protective device 1 of a power tool according to an embodiment of the present invention is illustrated in FIG. 1 to FIG. 12, wherein the protective device 1 is disposed on the power tool (not shown) and is adapted to be passed through by an output shaft of the power tool. The output shaft of the power tool is connected to a tool bit which is a grinding wheel 100 as an example, wherein the power tool is a hand grinder as an example. The protective device 1 includes a fixing base 10, a restricting ring 26, a plurality of springs 36, a protective cover 38, and a locking member 46.

Figure 4:
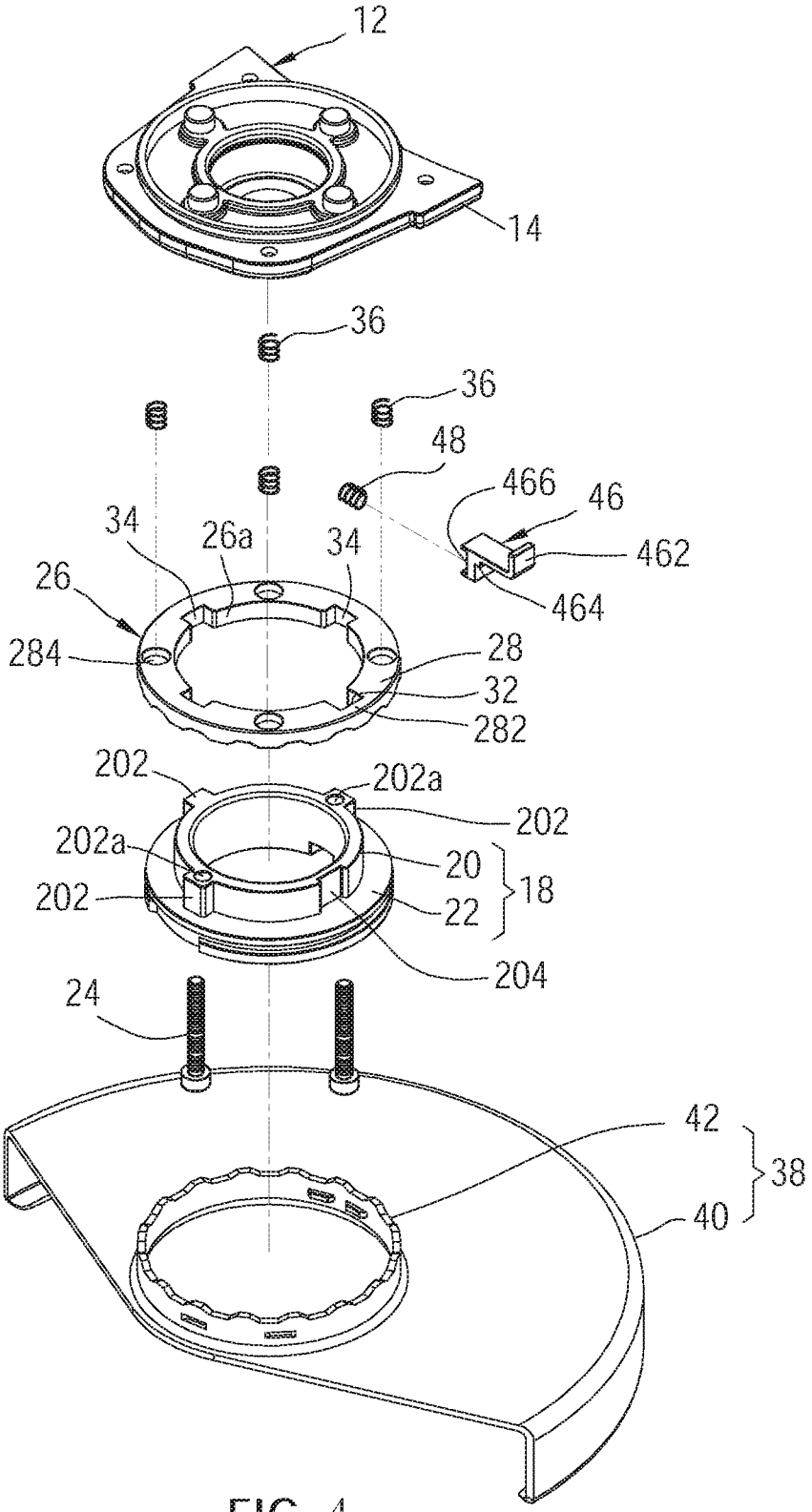
FIG. 4 is an exploded view of the protective device according to the embodiment of the present invention.
Figure 5:
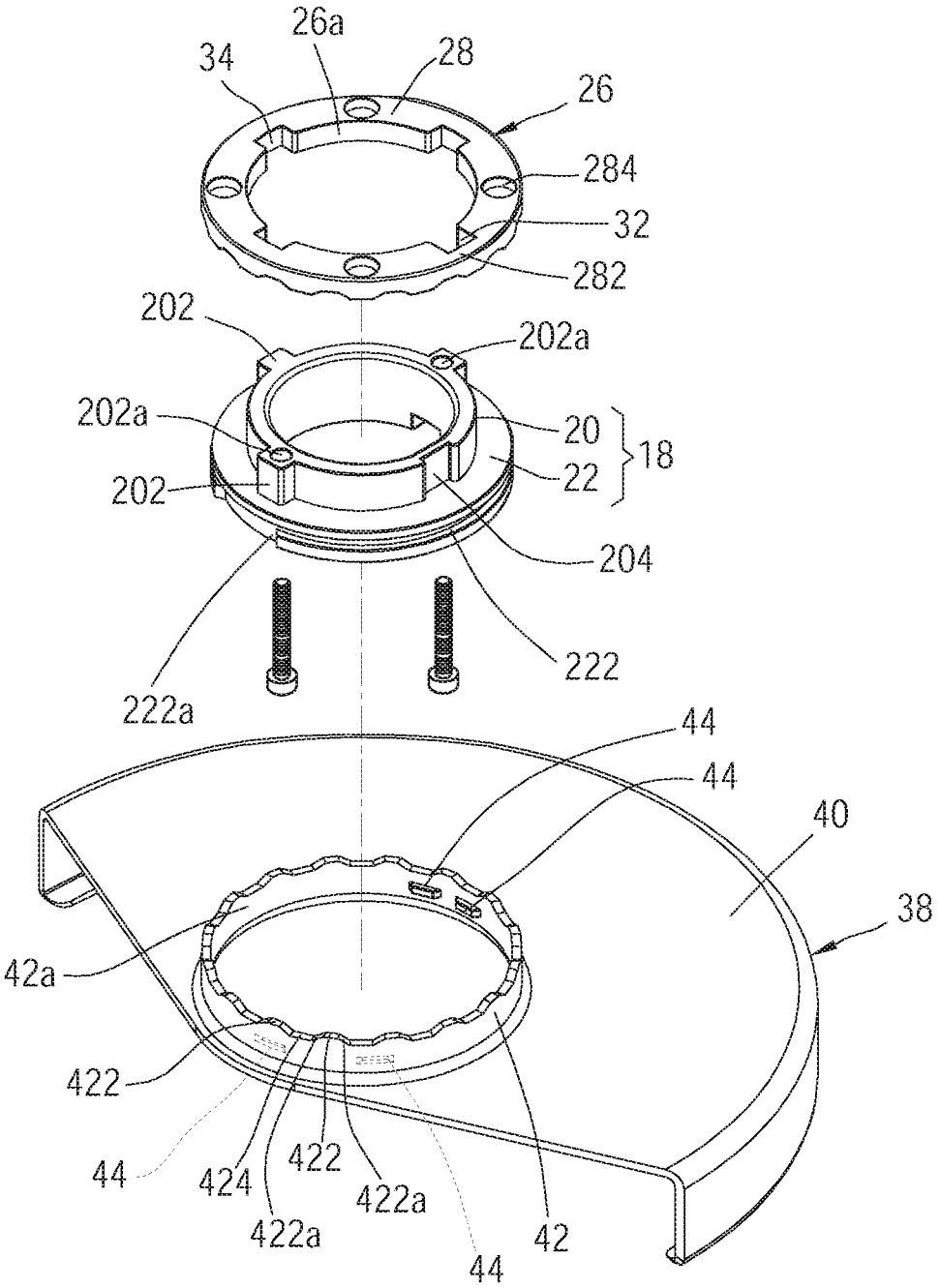
FIG. 5 is a partially exploded view of the protective device according to the embodiment of the present invention.
Figure 6:
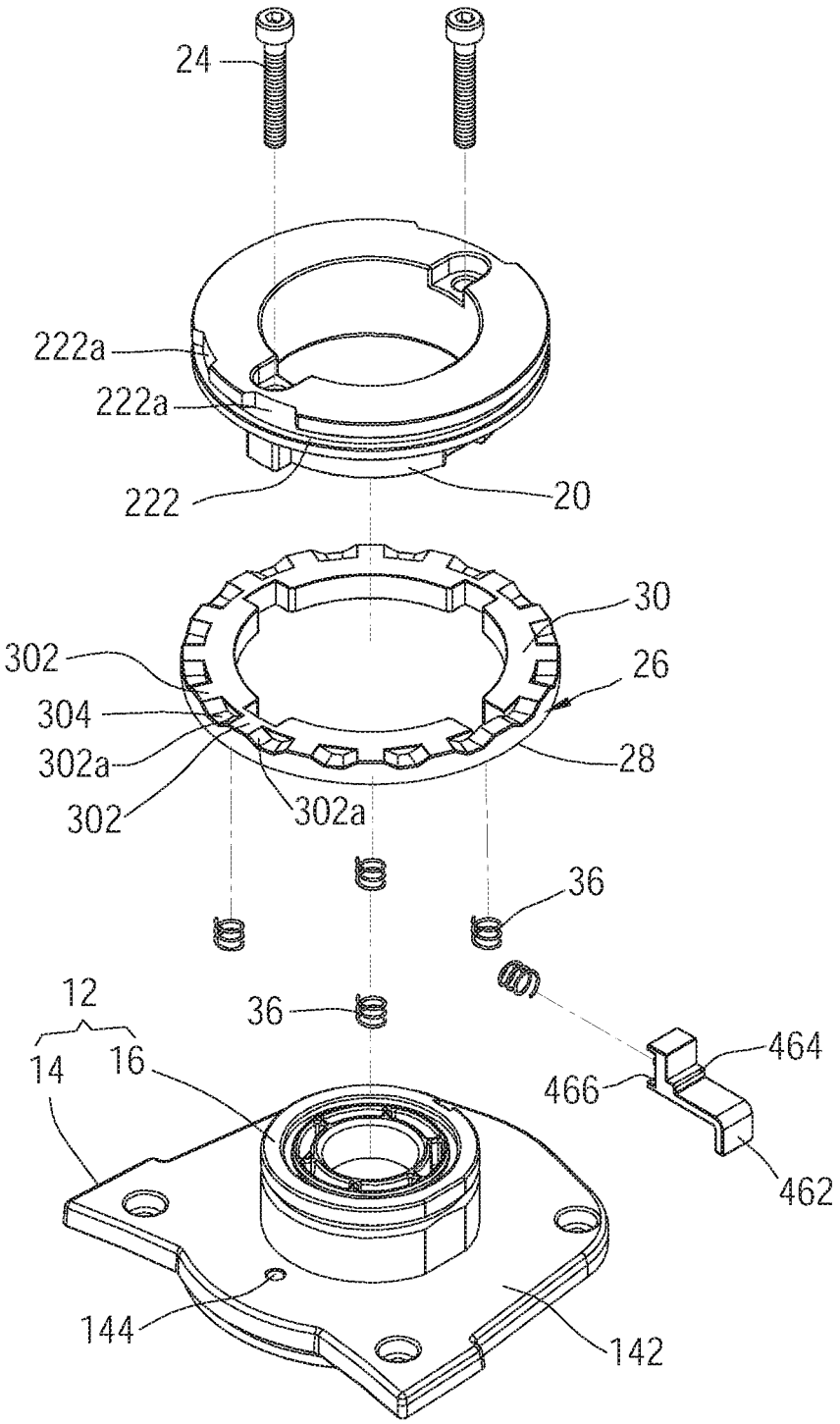
FIG. 6 is a partially exploded view of the protective device according to the embodiment of the present invention.

Referring to FIG. 4 to FIG. 6, the fixing base 10 is adapted to be engaged with the power tool and has a tube portion 20 and an abutting surface 142, wherein the tube portion 20 is adapted to be passed through by the output shaft of the power tool. In the current embodiment, the fixing base 10 includes a first body 12 and a second body 18, wherein the first body 12 includes an engaging plate 14 and an inner tube 16. The engaging plate 14 is adapted to be engaged with the power tool and has the abutting surface 142. Two threaded holes 144 are disposed on the abutting surface. The inner tube 16 is adapted to be passed through by the output shaft of the power tool. The second body 18 is engaged with the first body 12 via two bolts 24 screwing into the two threaded holes 144, and has the tube portion 20. The tube portion 20 fits around the inner tube 16, so that the abutting surface 142 is located outside of the tube portion 20, and the output shaft is located in the tube portion 20. The second body 18 further has a flange 22 connected to the tube portion 20, wherein the flange 22 has an outer peripheral surface. An annular groove 222 is disposed on the outer peripheral surface of the flange 22 and has two open ends 222*a* which face a direction away from the abutting surface 142 of the fixing base 10 and are located at two opposite sides of the annular groove 222. An outer peripheral surface of the tube portion 20 has three positioning blocks 202, wherein each of two of the positioning blocks 202 has a perforation 202*a* for being correspondingly passed through by the bolts 24. A receiving recess 204 is recessed into the outer peripheral surface of the tube portion 20.

The restricting ring 26 has a through hole 26*a* fitting around the tube portion 20, and could be moved along an axial direction of the tube portion 20, and has a first end 28 and a second end 30 which face opposite directions. The first end 28 faces the abutting surface 142 of the fixing base 10 and has an abutting portion 282. The second end 30 has a plurality of first projections 302 which are arranged in an annular shape and are arranged at intervals and a plurality of first recesses 304 which are arranged in an annular shape and are arranged at intervals. The first projections 302 and the first recesses 304 are arranged alternately. Each of two opposite sides of each of the first projections 302 has a first inclined surface 302*a*. The first end 28 of the restricting ring 26 has a plurality of recesses 284 recessed thereinto and corresponding to the abutting surface 142 of the fixing base 10.

The restricting ring 26 further has a notch 32 corresponding to the receiving recess 204 of the tube portion 20 in a radial direction of the restricting ring 26, wherein the notch 32 is recessed into a wall of the through hole 26*a* in the radial direction of the restricting ring 26 and forms a free end at the first end 28. In the radial direction of the restricting ring 26, the abutting portion 282 is located outside of the free end. The restricting ring 26 further has three positioning grooves 34, wherein each of the positioning grooves 34 communicates the first end 28 and the second end 30 in an axial direction of the restricting ring 26. The three positioning blocks 202 on the outer peripheral surface of the tube portion 20 are respectively disposed in the three positioning grooves 34 to restrict the restricting ring 26 from rotating. In practice, the restricting ring 26 could include at least one positioning groove 34, and the tube portion 20 of the fixing base 10 could include at least one positioning block 202, which could restrict the restricting ring 26 from rotating as well.

The springs 36 are disposed between the abutting surface 142 of the fixing base 10 and the first end 28 of the restricting ring 26. More specifically, an end of each of the springs 36 is disposed in one of the recesses 284 of the first end 28 and abuts against a bottom surface of the corresponding recess 284.

The protective cover 38 is rotatably disposed on the fixing base 10, wherein the restricting ring 26 is located between the protective cover 38 and the abutting surface 142 of the fixing base 10. More specifically, the protective cover 38 includes a cover body 40 and an engaging ring 42, wherein the cover body 40 fits around an outside of the grinding wheel 100. An end of the engaging ring 42 has a plurality of second projections 422 which are arranged in an annular shape and are arranged at intervals and a plurality of second recesses 424 which are arranged in an annular shape and are arranged at intervals, wherein the second projections 422 and the second recesses 424 are arranged alternately. Each of two opposite sides of each of the second projections 422 has a second inclined surface 422*a*. A plurality of protrusions 44 is formed by protruding inward from an inner peripheral surface 42*a* of the engaging ring 42 in a radial direction of the engaging ring 42. When the engaging ring 42 fits around the flange 22 of the second body 18 of the fixing base 10, the protrusions 44 enter the annular groove 222 respectively via the open ends 222*a* to move along the annular groove 222, thereby to rotate the protective cover 38 relative to the fixing base 10. Each of the second projections 422 of the engaging ring 42 is disposed in one of the first recesses 304 of the restricting ring 26, and each of the first projections 302 of the restricting ring 26 is disposed in one of the second recesses 424 of the engaging ring 42, wherein each of the first inclined surfaces 302*a* faces one of the second inclined surfaces 422*a*.

Figure 7:
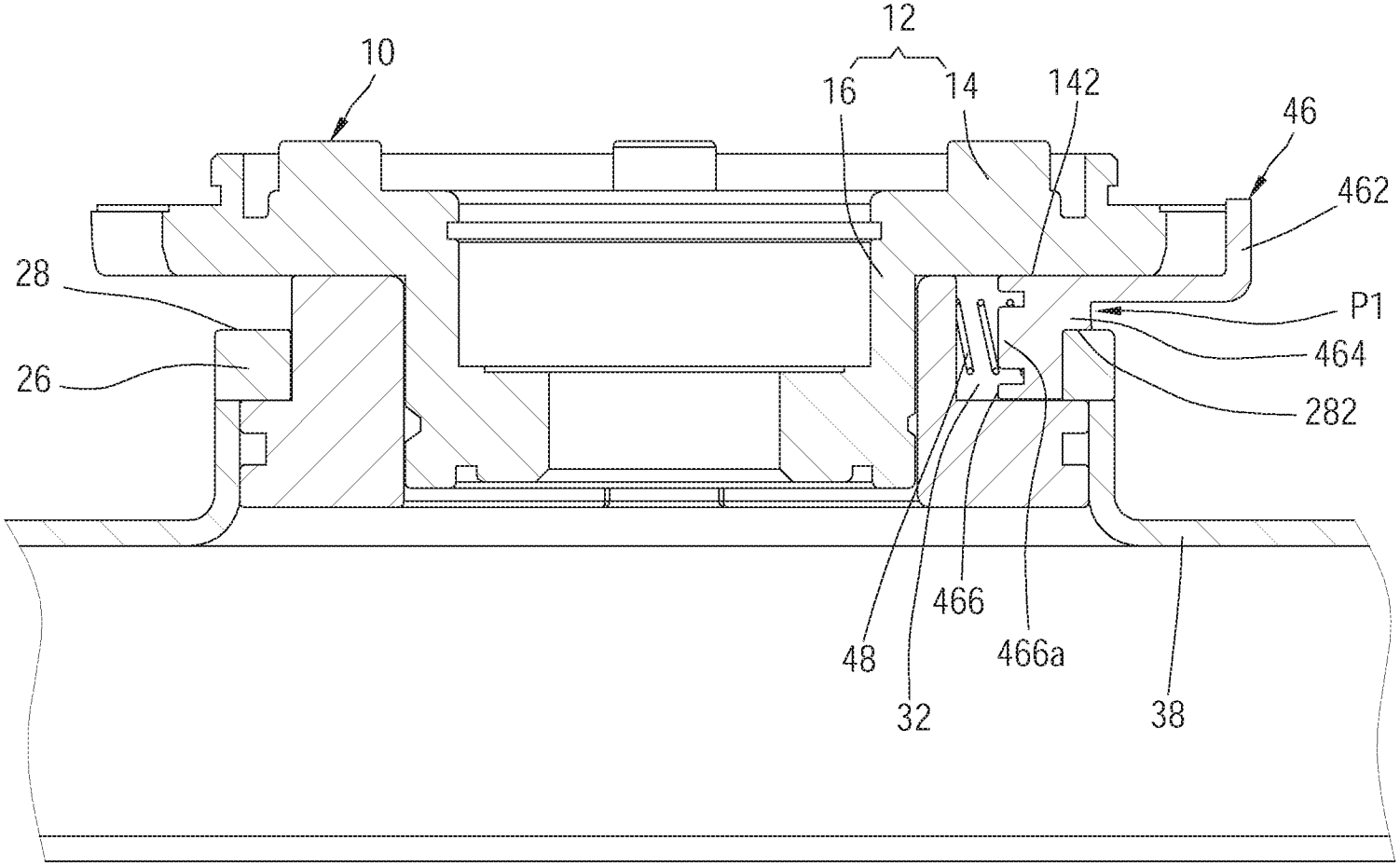
FIG. 7 is a sectional view along the 7-7 line in FIG. 3, showing the blocking portion of the locking member is located at the first position.
Figure 8:
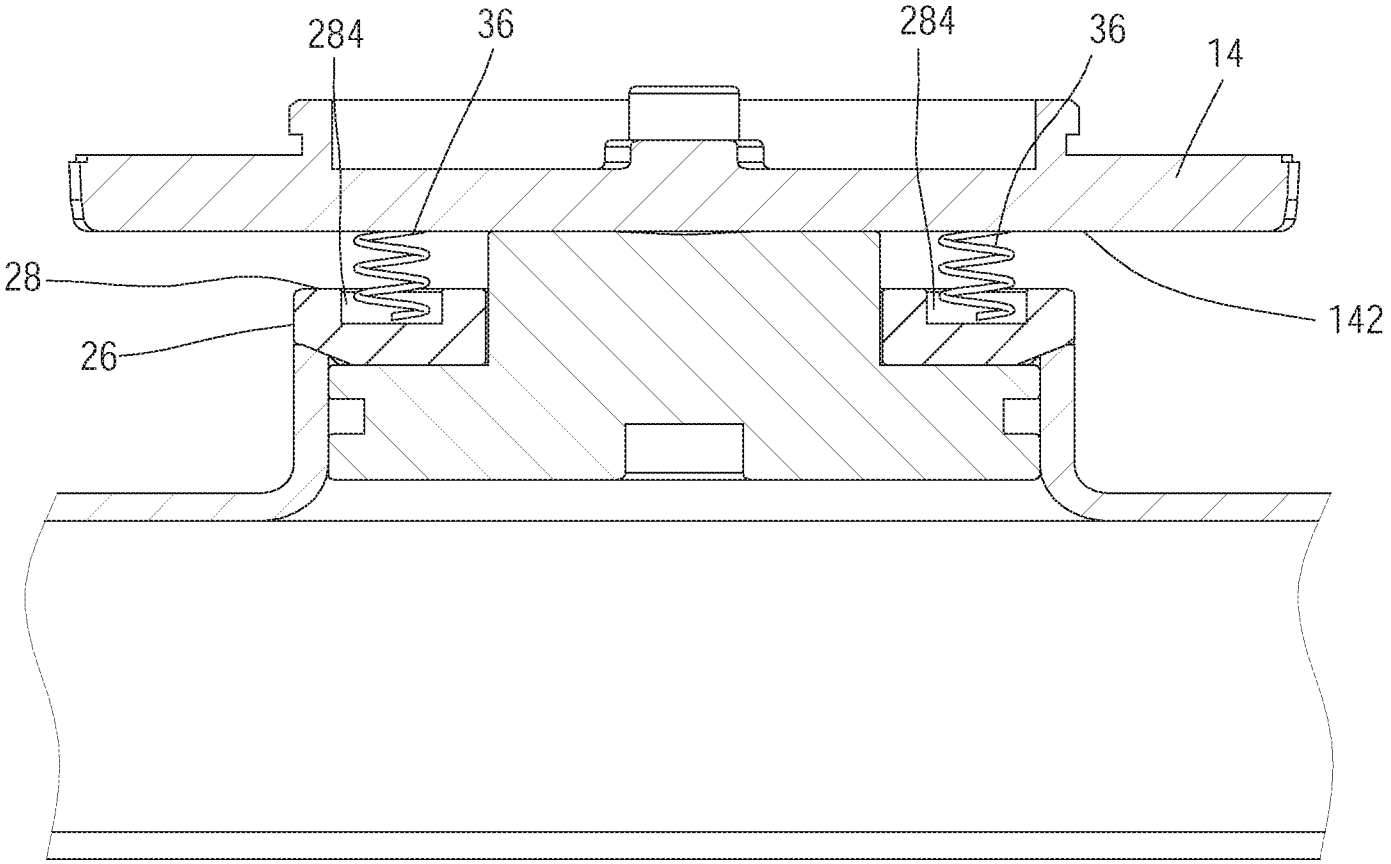
FIG. 8 is a sectional view along the 8-8 line in FIG. 3.
Figure 9:
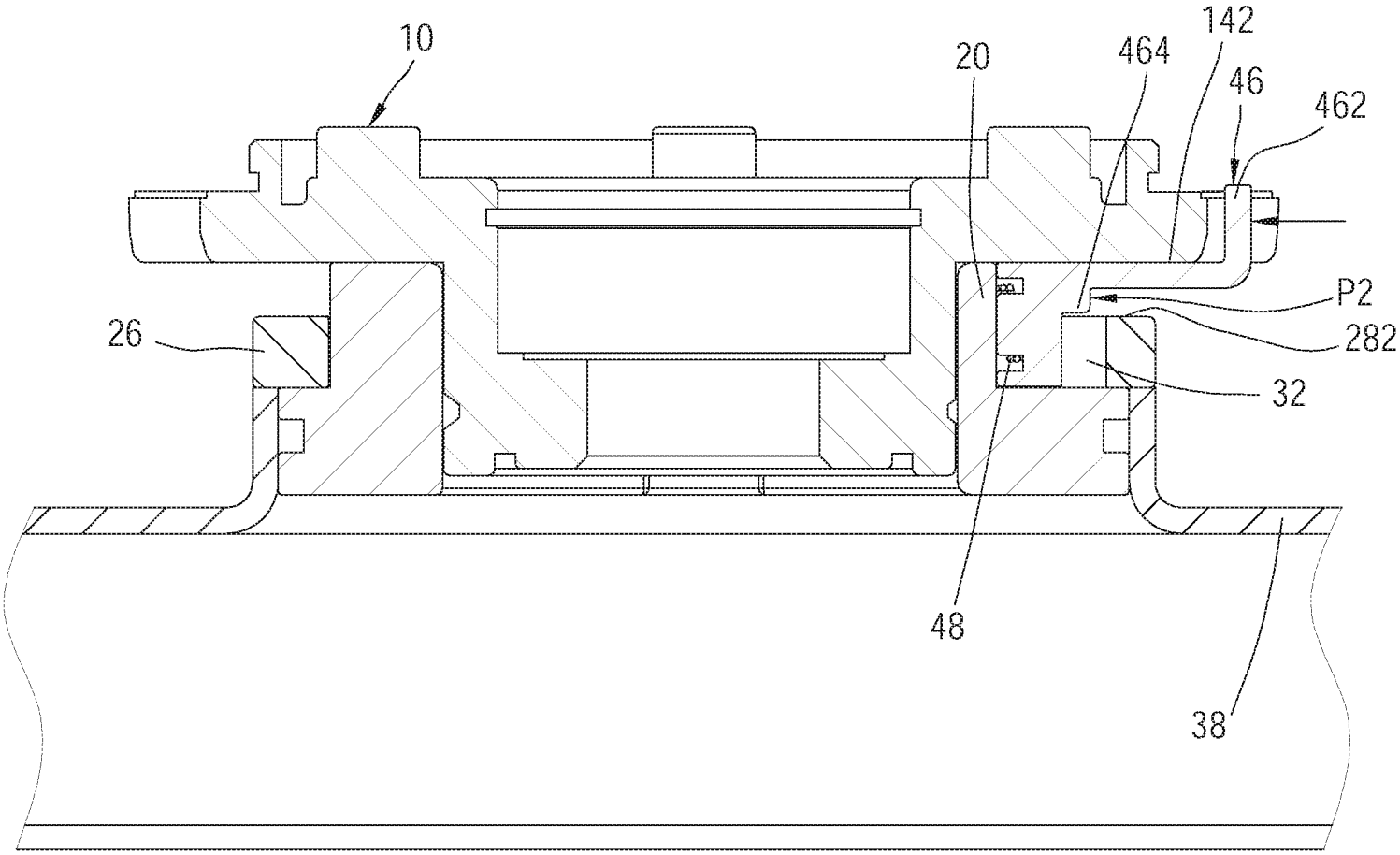
FIG. 9 is similar to FIG. 7, showing the blocking portion of the locking member is located at the second position.

The locking member 46 is disposed between the restricting ring 26 and the fixing base 10 and has an operating portion 462 and a blocking portion 464, wherein the operating portion 462 is located outside the engaging plate 14 of the fixing base 10 for being operated by a user, thereby to move the blocking portion 464 between a first position P1 shown in FIG. 7 and a second position P2 shown in FIG. 9. In the current embodiment, the locking member 46 further has an extending portion 466 which is disposed in the notch 32 of the restricting ring 26 and could be moved in the radial direction of the restricting ring 26 with the movement of the operating portion. A restoring spring 48 is disposed in the notch 32 of the restricting ring 26, and abuts against the extending portion 466 of the locking member 46 to provide a reverse force for urging the blocking portion 464 to maintain at first position P1 in a normal state (i.e., without an external force). More specifically, the extending portion 466 of the locking member 46 has a protruding block 466*a*, wherein an end of the restoring spring 48 fits around the protruding block 466*a* and abuts against the extending portion 466, and another end of the restoring spring 48 abuts against a bottom surface of the receiving recess 204 of the tube portion 20 in the radial direction of the restricting ring 26.

A restoring spring 48 is disposed in the notch 32 of the restricting ring 26, and abuts against the extending portion 466 of the locking member 46 to provide a reverse force for urging the blocking portion 464 to maintain at first position P1 in a normal state (i.e., without an external force). More specifically, the extending portion 466 of the locking member 46 has a protruding block 466*a*, wherein an end of the restoring spring 48 fits around the protruding block 466*a* and abuts against the extending portion 466, and another end of the restoring spring 48 abuts against a bottom surface of the receiving recess 204 of the tube portion 20 in the radial direction of the restricting ring 26.

Referring to FIG. 7, when the operating portion 462 of the locking member 46 is not pressed, the blocking portion 464 is located at the first position P1 (i.e., the blocking portion 464 is located between the abutting surface 142 of the fixing base 10 and the blocking portion 464, blocking portion of the first end 28 of the restricting ring 26). At this time, when the user exerts a force to turn the protective cover 38, the restricting ring 26 is abutted against the blocking portion 464, and therefore cannot move toward the abutting surface 142 of the fixing base 10, so that an angle of the protective cover 38 cannot be changed.

Figure 10:
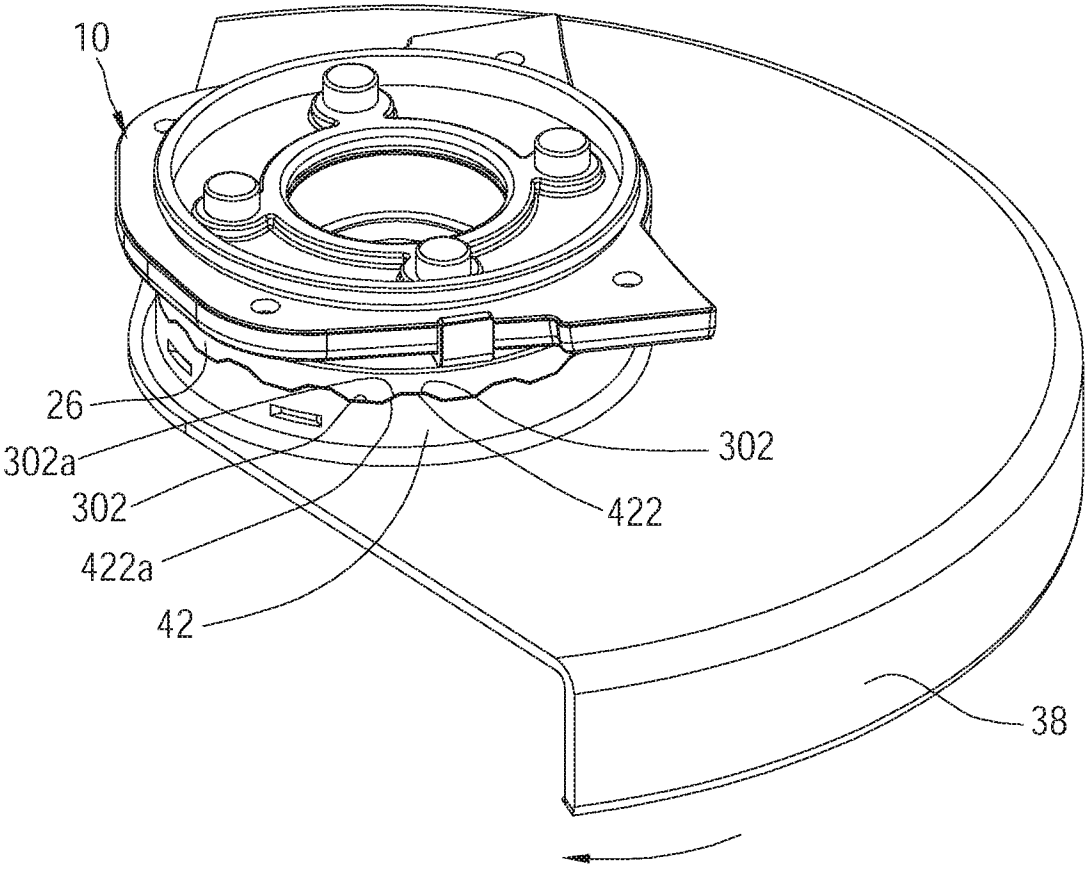
FIG. 10 is a perspective view, showing the protective cover is rotated.
Figure 11:
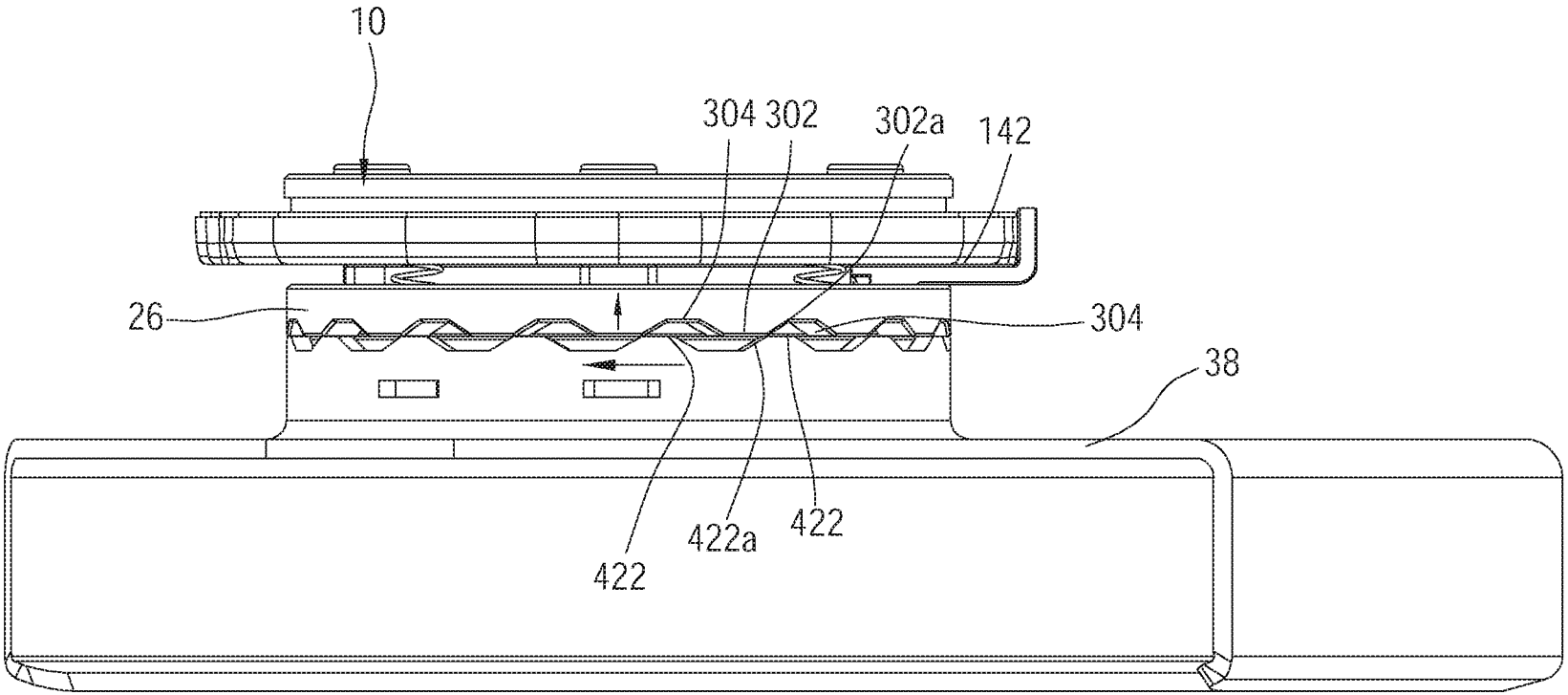
FIG. 11 is a schematic view, showing the restricting ring is pushed upward.
Figure 12:
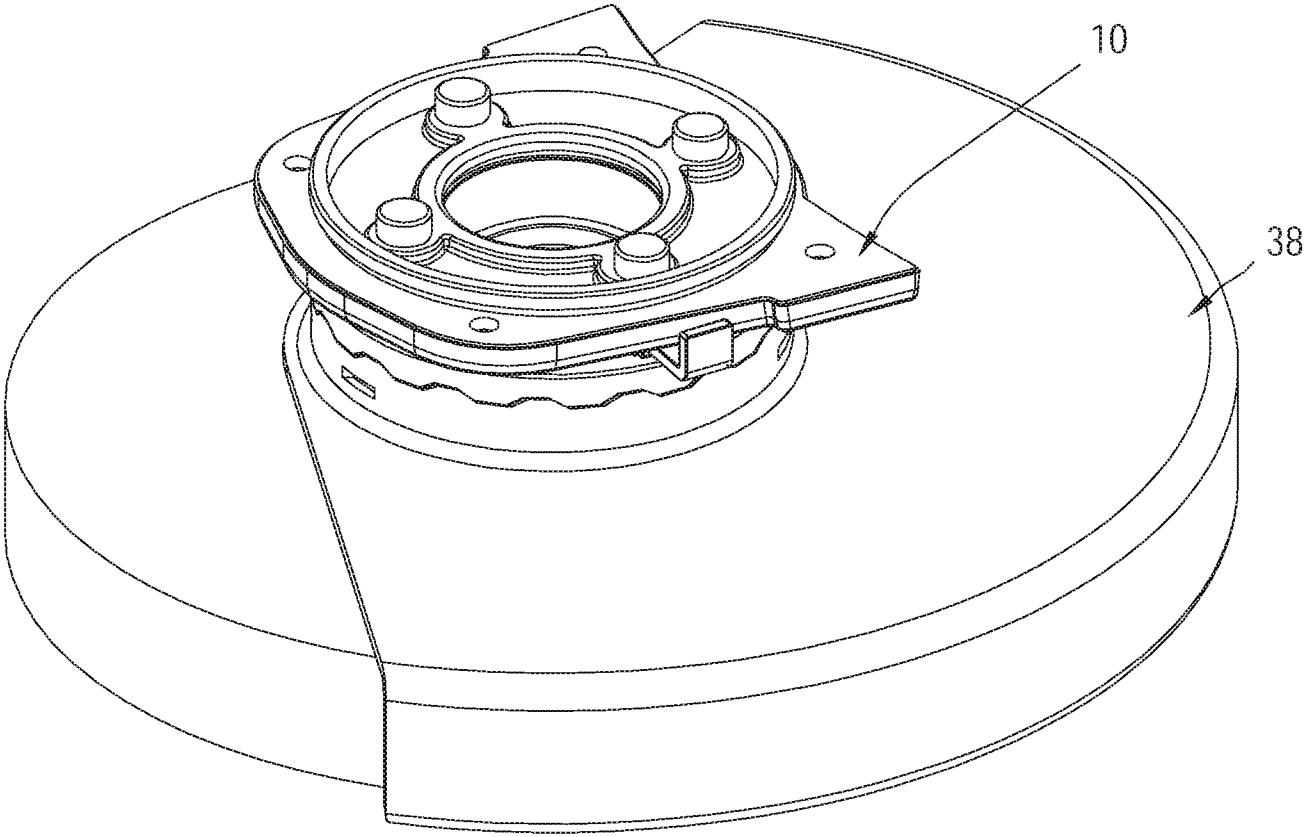
FIG. 12 is a perspective view, showing the angle of the protective cover is changed.

Referring to FIG. 9, when the operating portion 462 of the locking member 46 is pressed toward the tube portion 20 by the user, the blocking portion 464 moves to the second position P2 with the movement of the operating portion 462. At this time, the blocking portion 464 leaves a position between the abutting surface 142 of the fixing base 10 and the abutting portion 282 of the restricting ring 26 to be located within an orthogonal projection area of the notch 32 of the restricting ring 26. Referring to FIG. 10 and FIG. 11, when the user exerts a force to turn the protective cover 38, one of the second inclined surfaces 422*a* of each of the second projections 422 of the engaging ring 42 of the protective cover 38 pushes one of the first inclined surfaces 302*a* of one of the first projections 302 of the restricting ring 26, wherein each of the second projections 422 could leave the corresponding first recess 304 to push the restricting ring 26 toward a direction of the abutting surface 142 of the fixing base 10. In this way, by continuously rotating the protective cover, the angle of the protective cover 38 could be changed and adjusted to the angle required by the user (e.g. the angle shown in FIG. 12). After that, the springs 36 urge the restricting ring 26 to move toward the protective cover 38, so that each of the first projections 302 could enter one of the second recesses 424.

After the user releases the operating portion 462 of the locking member 46, the restoring spring 48 pushes the extending portion 466 of the locking member 46 to move the blocking portion 464 back to the first position P1 shown in FIG. 7, thereby to restrict the protective cover 38 from being rotated.

In an embodiment, the restoring spring 48 could be omitted. More specifically, the user could manually pull out the operating portion 462 of the locking member 46 to move the blocking portion 464 back to the first position P1.

With the aforementioned design, the angle of the protective cover 38 could be adjusted by the user to meet various requirements, which makes the use of the power tool easier and more convenient and safe.

It must be pointed out that the embodiments described above are only some preferred embodiments of the present invention. All equivalent structures which employ the concepts disclosed in this specification and the appended claims should fall within the scope of the present invention.

What is claimed is:

1. A protective device of a power tool, comprising:

a fixing base adapted to be engaged with the power tool and having a tube portion and an abutting surface, wherein the tube portion is adapted to be passed through by an output shaft of the power tool; the abutting surface is located on an outer periphery of the tube portion;

a restricting ring which fits around the tube portion and is movable in an axial direction of the tube portion, wherein the restricting ring has a first end and a second end which face opposite directions; the first end faces the abutting surface of the fixing base and has an abutting portion; the second end has a plurality of first projections which are arranged in an annular shape and are arranged at intervals and a plurality of first recesses which are arranged in an annular shape and are arranged at intervals; the first projections and the first recesses are arranged alternately;

a plurality of springs disposed between the abutting surface of the fixing base and the first end;

a protective cover rotatably disposed on the fixing base, wherein the restricting ring is located between the protective cover and the abutting surface of the fixing base; the protective cover has an engaging ring; the engaging ring has a plurality of second projections which are arranged in an annular shape and are arranged at intervals and a plurality of second recesses which are arranged in an annular shape and are arranged at intervals; the second projections and the second recesses are arranged alternately; each of the second projections is disposed in one of the first recesses, and each of the first projections is disposed in one of the second recesses; and a locking member disposed between the restricting ring and the fixing base and having an operating portion and a blocking portion, wherein the operating portion is adapted to be operated by a user, thereby to move the blocking portion between a first position and a second position; when the blocking portion is located at the first position, the blocking portion is located between the abutting surface of the fixing base and the abutting portion of the first end of the restricting ring, thereby to restrict the restricting ring from moving toward the abutting surface of the fixing base; when the blocking portion is located at the second position, the blocking portion is not located between the abutting surface of the fixing base and the abutting portion of the first end of the restricting ring, so that when the protective cover is rotated, each of the second projections leaves the corresponding first recess to push the restricting ring toward the abutting surface of the fixing base.

2. The protective device of claim 1, wherein the restricting ring has a through hole and a notch; the through hole fits around the tube portion of the fixing base; the notch of the restricting ring forms a free end at the first end; the abutting portion is located outside of the free end in a radial direction of the restricting ring; the locking member has an extending portion which is disposed in the notch of the restricting ring and is movable in the radial direction of the restricting ring; when the blocking portion is located at the second position, the blocking portion is located within an orthogonal projection area of the notch of the restricting ring.

3. The protective device of claim 2, further comprising a restoring spring disposed in the notch of the restricting ring and abutting against the extending portion of the locking member.

4. The protective device of claim 3, wherein the notch of the restricting ring is recessed into a wall defining the through hole in the radial direction of the restricting ring; an end of the restoring spring abuts against the extending portion, and another end of the restoring spring abuts against the tube portion of the fixing base.

5. The protective device of claim 4, wherein the tube portion has a receiving recess corresponding to the notch of the restricting ring; the another end of the restoring spring abuts against a bottom surface of the receiving recess.

6. The protective device of claim 5, wherein the extending portion of the locking member has a protruding block; the end of the restoring spring fits around the protruding block.

7. The protective device of claim 1, wherein the fixing base has an outer peripheral surface; an annular groove is disposed on the outer peripheral surface; the engaging ring has a plurality of protrusions disposed in the annular groove.

8. The protective device of claim 7, wherein the annular groove has two open ends; the protrusions enter the annular groove respectively via the open ends.

9. The protective device of claim 7, wherein the fixing base comprises a first body and a second body; the first body has the abutting surface; the second body is engaged with the first body and has the tube portion and the annular groove.

10. The protective device of claim 1, wherein the restricting ring has at least one positioning groove; two ends of the at least one positioning groove communicate the first end and the second end; the tube portion has at least one positioning block disposed in the at least one positioning groove.

11. The protective device of claim 1, wherein each of two opposite sides of each of the first projections has a first inclined surface; each of two opposite sides of each of the second projections has a second inclined surface; each of the first inclined surfaces faces one of the second inclined surfaces.

12. The protective device of claim 1, wherein the first end of the restricting ring has a plurality of recesses; an end of each of the springs is disposed in one of the recesses.

* * * * *